US006551550B1

(12) United States Patent
Aramaki et al.

(10) Patent No.: US 6,551,550 B1
(45) Date of Patent: Apr. 22, 2003

(54) GAS BLOWING PLUG AND MANUFACTURING METHOD THEREFOR

(75) Inventors: Keizo Aramaki, Gifu (JP); Tsuyoshi Yoshida, Gifu (JP)

(73) Assignee: Tokyo Yogyo Kabushiki Kaisha (JP)

( * ) Notice: Subject to any disclaimer, the term of this patent is extended or adjusted under 35 U.S.C. 154(b) by 0 days.

(21) Appl. No.: 09/641,314

(22) Filed: Aug. 18, 2000

(30) Foreign Application Priority Data

Aug. 19, 1999 (JP) ..... 11-232425

(51) Int. Cl.[7] ..... C21C 5/48
(52) U.S. Cl. ..... 266/220; 266/217
(58) Field of Search ..... 266/220, 217

(56) References Cited

U.S. PATENT DOCUMENTS 5,225,143 A * 7/1993 LaBate, II et al. ..... 266/220

FOREIGN PATENT DOCUMENTS

| | | | | |
|---|---|---|---|---|
| EP | 0 329 645 A | | 8/1989 | |
| JP | 408157939 A | * | 6/1996 | ..... 266/217 |
| JP | 411071610 A | * | 3/1999 | ..... 266/217 |

OTHER PUBLICATIONS

Patent Abstracts of Japan, vol. 1999, No. 09, Jul. 30, 1999 (07–30–1999) & JP 11 117014 A (Kawasaki Refract Co Ltd), Apr. 27, 1999 (04–27–1999) *abstract*.

Database WPI Section Ch, Week 199914 Derwent Publications Ltd., London, GB; Class M24, AN 1999–163469 XPOO2214001 & JP 11 021611 A (Shinagawa Fire Brick), Jan. 26, 1999 (01–26–1999) *abstract* & Patent Abstracts of Japan vol. 1999, No. 04 Apr. 30, 1999 (04–30–1999) & JP 11 021611 A (Shingawa Refract Co Ltd), Jan. 26, 1999 (01–26–1999) *abstract* *figures*.

Database WPI, Section Ch, Week 200022 Derwent Publications Ltd., London, GB; Class M22, AN 2000–250347 XPOO2214002 & JP 2000 061594 A (Tokyo Yogyo KK), Feb. 29, 2000 (02–29–2000) *abstract* & Patent Abstract of Japan vol. 2000, No. 05, Sep. 14, 2000 (09–14–2000) & JP 2000 061594 A (Tokyo Yogyo Co Ltd), Feb. 29, 2000 (02–29–2000) *abstract* *figures*.

* cited by examiner

*Primary Examiner*—Scott Kastler
(74) *Attorney, Agent, or Firm*—Cohen & Grigsby, P.C.

(57) ABSTRACT

A gas blowing plug and a manufacturing method therefor wherein the gas blowing plug includes a slit-shaped gas passage (22) ranging from the bottom to the top of the plug. The gas passage (22) is continuous or discontinuous in a horizontal cross section of the plug. The slit-shaped gas passage (22) is also continuous from the bottom to the top of the plug and slit-shaped gas passage (26) is discontinuous in a vertical cross section of the plug. In one example, the cross-sectional shape of the slit-shaped gas passage (22) is a pointed star.

18 Claims, 7 Drawing Sheets

FIG. 7

| | | Conv. Plug | Examples of Invention | | |
|---|---|---|---|---|---|
| Material | | $Al_2O_3$ | $Al_2O_3$ | $Al_2O_3$ - MgO | MgO - $Cr_2O_3$ |
| Porosity (%) | | 23.0 | 15.0 | 13.0 | 17.0 |
| Bulk Density ($g/m^3$) | | 2.85 | 2.94 | 3.00 | 3.20 |
| Compression Strength (MPa) | | 50 | 80 | 120 | 50 |
| $Al_2O_3$ (wt%) | | 90 | 97.0 | 92.0 | 14.0 |
| $SiO_2$ (wt%) | | 6.0 | 1.5 | | 1.8 |
| MgO (wt%) | | | | 3.0 | 55.0 |
| $Cr_2O_3$ (wt%) | | 2.0 | | | 26.0 |
| No. of charges applied | Stainless steel | 3 ~ 5 | 15 ~ 20 | 20 ~ 30 | -- |
| | Carbon steel | 15 ~ 20 | 40 ~ 50 | 50 ~ 60 | — |
| | FeCr bath | — | 5 ~ 10 | 10 ~ 15 | 30 ~ 50 |
| Vol. of gas blown Nl/min * | | 100 ~ 300 | 100 ~ 500 | 100 ~ 500 | 100 ~ 500 |

*Plug with 80 mm ∮ in dia, Gas Pressure (gauge): $1kgf/cm^2$

GAS BLOWING PLUG AND MANUFACTURING METHOD THEREFOR

BACKGROUND OF THE INVENTION

1. Field of the Invention

The present invention relates to a gas blowing plug used for blowing gas to agitate molten metal in a ladle, electric furnace, converter, degassing apparatus, and the like.

2. Description of Related Art

Conventionally, in order to promote refining reaction of molten metal, especially molten steel contained in a ladle, gas blowing is often performed. As means for this purpose, a gas blowing plug is used. FIG. 8 shows a construction of a conventional plug. A well brick 4 is disposed among bottom bricks 5 disposed on the upper side of a permanent lining 6 at the bottom of a ladle. A porous plug 2 contained in a metal case 3 is inserted from the lower side of iron shell 7 of the ladle, is supported by a holding brick 8, which is fixed by a holding plug 10. Blowing gas is supplied through a gas pipe 12, and is blown into molten metal in the ladle through the porous plug 2.

The conventional plug is made of a highly permeable refractory material, and blows Ar or $N_2$ gas to cause non-metallic inclusion to float up or to make the temperature uniform. As the refractory material, alumina materials, magnesia materials, zircon materials, or the like are used. The permeability is approximately in the range of 0.5 to 8 $cm^3$-cm/$cm^2$-s-$cmH_2O$.

However, since the permeability must be ensured to blow a large amount of gas, it is necessary to make the material have a low density, so that the life of plug is impaired. To increase the life, the material of brick must be made dense, therefore the permeability must be decreased. Hence, it is difficult to manufacture a desirable porous plug.

To solve this problem, for example, Unexamined Japanese Patent Publication No. 11-117014 has disclosed a method in which a hot-melt sheet is formed in a spiral form, and is embedded in a refractory material and fired to make a dense plug after melting the sheet with a spiral slit inside. However, after the plug is once used, molten metal intrudes in a spiral-form slit and solidifies, so that it is sometimes difficult to blow gas into the molten metal for the next turn.

In such a case, it is normally necessary to increase the gas pressure to blow off the clogged portion. Therefore, the plug is consumed by about 5 to 20 mm for each blowing-off operation, so that the life of porous plug is decreased. When the molten metal intrudes into the slit deeply, it is sometimes difficult to blow off this portion, and in some cases, gas cannot be blown.

SUMMARY OF THE INVENTION

Accordingly, the inventor of the present invention reached an idea that a plug provided with discontinuous shallow slits having a difference in height limits the intrusion depth of molten metal in the slits can solve the above problems, and consequently made the invention as described below.

The first embodiment of the present invention provides a gas blowing plug for blowing gas from the bottom of a molten metal vessel, comprising;

a slit-shaped gas passage ranging from the bottom to the top of said plug, which forms a continuous slit-shaped gas passage in the horizontal cross section of said plug;

said slit-shaped gas passage forming a continuous passage from the bottom to the top of said plug; and a discontinuous slit-shaped gas passage in the vertical cross section of the plug.

The second embodiment of the present invention provides a gas blowing plug for blowing gas from the bottom of a molten metal vessel, comprising;

a slit-shaped gas passage ranging from the bottom to the top of said plug, which forms a discontinuous slit-shaped gas passage in the horizontal cross section of said plug;

said slit-shaped gas passage continuous from the bottom to the top of said plug in the vertical cross section of the plug; and a discontinuous slit-shaped gas passage in the vertical cross section of said plug.

The third embodiment of the present invention provides the gas blowing plug, wherein said slit-shaped gas passage is formed by a continuous or discontinuous slit-shaped gas passage having a star shape in the horizontal cross section of the plug.

The fourth embodiment of the present invention provides the gas blowing plug, wherein said star shape is any one shape of three-pointed, four-pointed, five-pointed, or six-pointed star.

The fifth embodiment of the present invention provides the gas blowing plug, wherein said slit-shaped gas passage is formed in a multiple or spiral form around the centerline of the horizontal cross section of said plug.

The sixth embodiment of the present invention provides a manufacturing method for a gas blowing plug, comprising the steps of:

(a) preparing a tubular body made of a plane-shaped combustible sheet, which is formed into a tubular shape, cuts are made at predetermined intervals in the direction perpendicular to the axial direction of said tubular body, and a band-shaped convex portion is formed by projecting the cut portion from the inside to the outside;

(b) disposing said tubular body in a mold, and filling the same with a monolithic refractory material; and (c) compressing said monolithic refractory material and then sintering the same.

The seventh embodiment of the present invention provides the manufacturing method for a gas blowing plug, wherein said band-shaped convex portion formed by the cut of said tubular body is a convex portion having an inclined portion inclining downward at both ends thereof.

The eighth embodiment of the present invention provides the manufacturing method for a gas blowing plug, wherein said plane-shaped combustible sheet is formed by a paper or plastic sheet with a thickness of 0.1 to 0.4 mm.

The ninth embodiment of the present invention provides the manufacturing method for a gas blowing plug, wherein said tubular body has any shape of three-pointed star, four-pointed star, five-pointed star, six-pointed star, or spiral in the vertical cross section .

The tenth embodiment of the present invention provides the manufacturing method for a gas blowing plug, wherein said tubular body is formed by disposing one or more tubular bodies with a different cross-sectional diameter in a multiple or spiral form around the center of a mold for said plug.

BRIEF DESCRIPTION OF THE DRAWINGS

FIG. 7 is a table showing plug characteristics in accordance with an embodiment of the present invention.

DETAILED DESCRIPTION OF THE PREFERRED EMBODIMENTS

Figure 1:
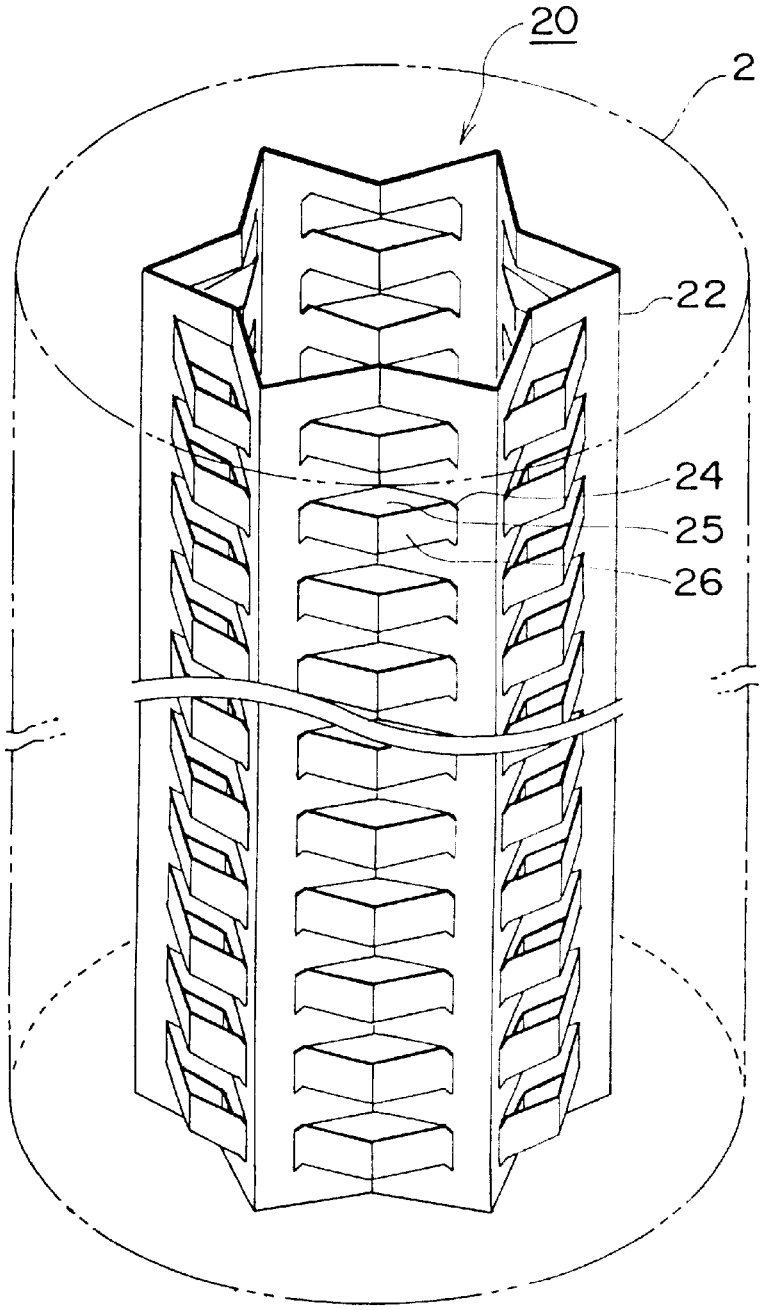
FIG. 1 is a perspective view showing a shape of a tubular body formed by a combustible sheet which provides a gas passage, which is used to manufacture a plug.

Embodiments of the present invention will now be described with reference to the accompanying drawings. For convenience in explaining, the manufacturing method is first described. FIG. 1 shows a tubular body 20 made of a plane-shaped combustible sheet used to manufacture a gas blowing plug in accordance with the present invention. The tubular body 20 is formed by a combustible sheet, i.e., a paper or plastic sheet with a thickness of 0.1 to 0.4 mm. This tubular body 20 is placed in a mold, is filled with a raw refractory material forming a plug, and is fired or sintered after being compressed appropriately.

By the firing or sintering, the sheet is burned off, and slits or gas passages corresponding to the shape of the sheet are formed in the plug made of refractory material. Therefore, this shape is a shape of slit-shaped gas passage in the plug. The shape of the tubular body varies depending on the size of the plug to be manufactured, and the diameter thereof is about 30 to 200 mm, and the height thereof is about 100 to 500 mm.

The shape can be such as to be the tubular body 20 of, for example, a six-pointed star shape in cross section as shown in the figure, which consists of main gas passages 22 forming the gas passage of slit running vertically. And convex portions 26 formed by projecting, to the outside, the cut portions provided at predetermined intervals in the direction perpendicular to the axis at the concave portions of the star shape.

The main gas passages 22 forming the gas passage may be a tubular shape with the same diameter in the height direction, or may be of a truncated cone shape as a whole whose diameter somewhat decreases toward the upper part. The star shape can be made a three-pointed to six-pointed star shape. Also, the shape may be a spiral one. Further, the shape may be a straight-line shape as a whole.

The convex portions may be formed at the same height in the peripheral direction, or may have a predetermined difference in height. A space 25 formed by this convex portion forms a connecting portion at which the refractory materials inside and outside the tubular body 20 are joined integrally. The chain line in the figure indicates the outside form of a plug 2 to be manufactured.

Figure 2:
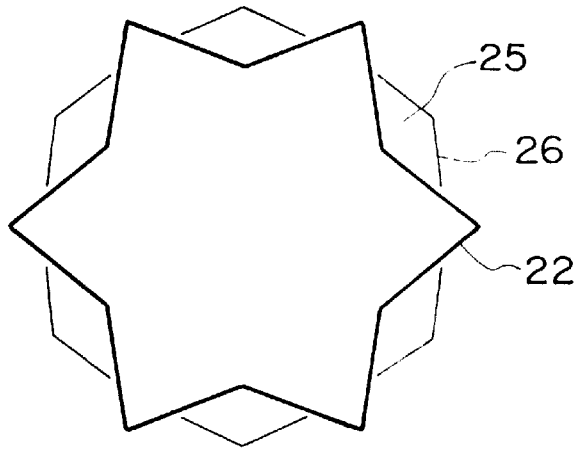
FIG. 2 is a plan view of the tubular body.

FIG. 2 is a plan view of the tubular body 20 shown in FIG. 1. The main gas passage 22, penetrating from the bottom to the top, forms a penetrating gas passage. The convex portion 26 is discontinuous in the vertical direction.

Figure 3:
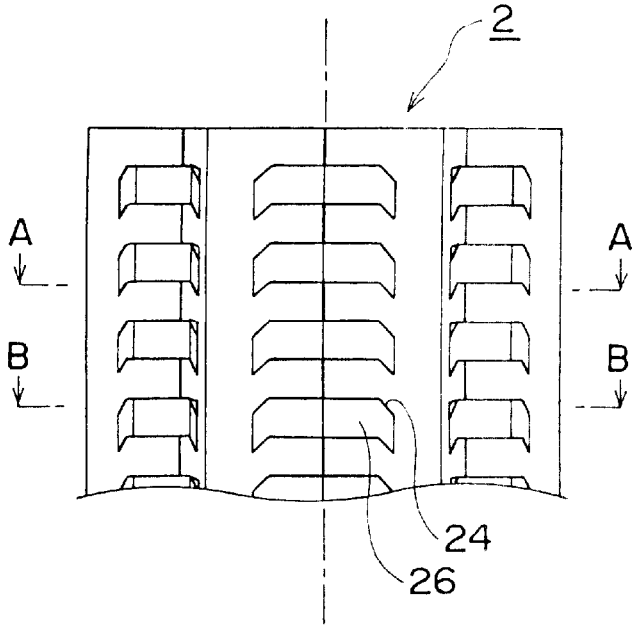
FIG. 3 is a side view of the tubular body.

FIG. 3 is a side view of the tubular body 20. Referring to FIG. 3 together with FIG. 1, the convex portion 26 comprises a portion projecting at right angles to the axis, which is preferably provided with a inclined portion at the both ends. The function of this inclined portion will be described later.

As described later, since the tubular body bums off when the plug is manufactured by firing or sintering, it also provides the shape of passage slit that is present in the plug.

FIGS. 4(A) and 4(B) are sectional views taken along the line A—A and line B—B of the side view of the tubular body 20 shown in FIG. 3, respectively. In FIG. 4(A), the solid line indicates a slit formed by the tubular body. A line-broken portion 240 is caused by an inclined portion 24 in FIG. 3. When the inclined portion 24 is absent, the slit becomes continuous. The dotted line indicates the slit formed by the convex portion that is present under this cross section.

FIG. 4(B), being a sectional view taken along the line B—B, shows the shape of slit formed by the convex portion. A line-broken portion 242 is a portion formed by the inclined portion at both ends of the band-shaped convex portion shown in FIG. 3, where a slit is absent. The dotted line indicates a slit formed by the main gas passage 22 just under this cross section.

The following is a description of the function of this line-broken portion. After the tubular body provided with the band-shaped convex portion having the inclined portion has been burned off, the manufactured plug has the slit-shaped gas passage in the range from the bottom to the top of the plug. The gas passage forms a continuous slit-shaped gas passage in the horizontal cross section of the plug, and forms the slit-shaped gas passage 22 continuously running from the bottom to the top of the plug and the discontinuous slit-shaped gas passage 26 in the vertical cross section of the plug.

Also, after the tubular body which is provided with the band-shaped convex portion having the inclined portion has been burned off, a plug is manufactured which has the slit-shaped gas passage in the range from the bottom to the top of the plug, and also the gas passage forms a discontinuous slit-shaped gas passage in the horizontal cross section of the plug and forms a slit-shaped gas passage continuous from the bottom to the top of the plug and a discontinuous slit-shaped gas passage in the vertical cross section of the plug.

As described above, depending on the shape of the tubular body, the main gas passage 22 forming the gas passage may have the same diameter in the height direction, or may have a diameter somewhat decreasing toward the upper part, being of a truncated cone shape as a whole. The star shape may form a three-pointed to six-pointed star shape. Also, the shape may be a spiral one. Further, the shape may be a straight-line shape as a whole.

Figure 4:
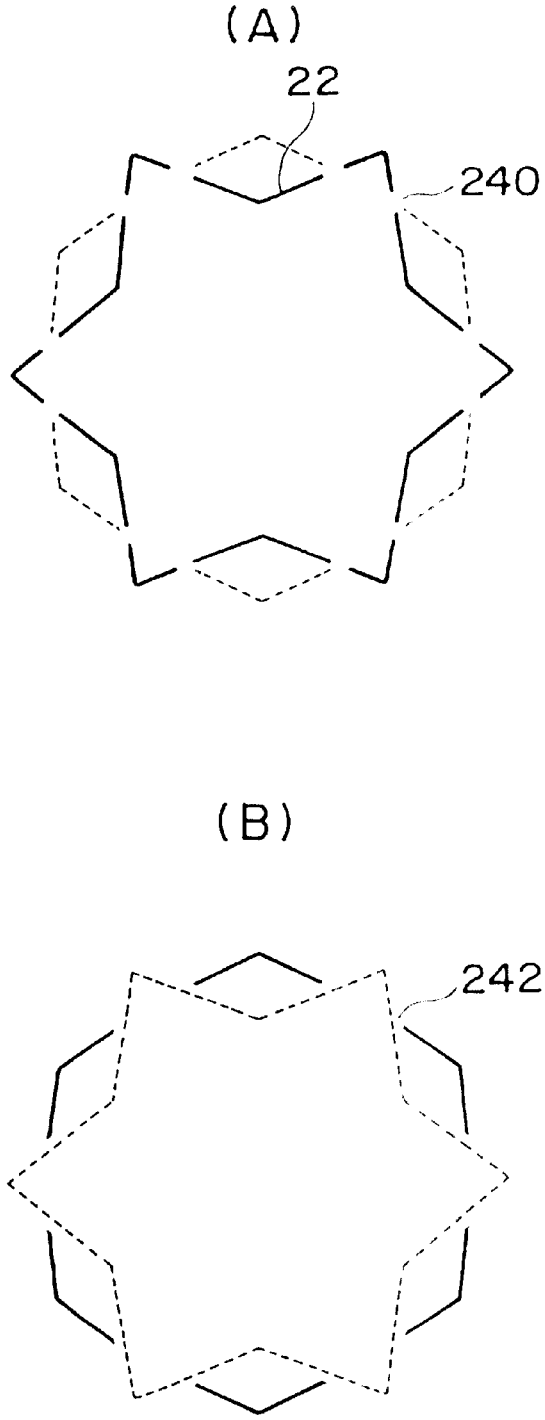
FIGS. 4A and 4B are views showing a slit in a cross section of a plug manufactured by inserting the tubular body.
Figure 5:
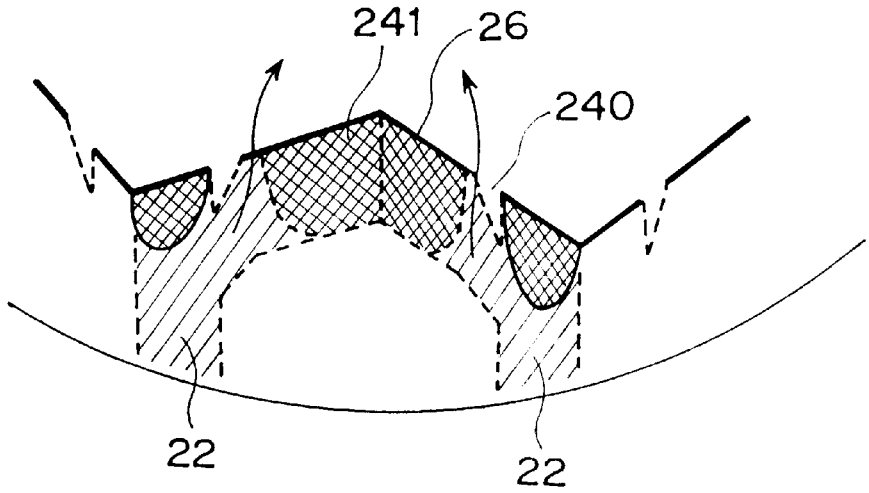
FIGS. 5A and 5B are perspective views showing a gas passage in a horizontal cross section of a plug in accordance with the present invention.
Figure 5:
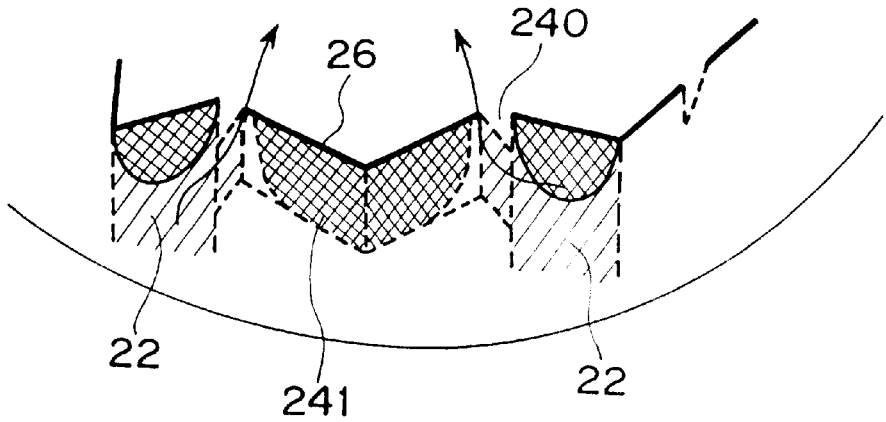

FIGS. 5(A) and 5(B) are perspective views of the horizontal cross sections shown in FIGS. 4(A) and 4(B). FIG. 5(A) is a perspective view of a slit shown in FIG. 4(A). When the gas blowing operation continues, the gas passing through the gas passage indicated by hatched area blows out from the slit indicated by the solid line. The gas does not blow out from the line-broken portion 240. When the gas blowing operation is finished, molten metal intrudes into the hatched portion as denoted by reference numeral 241, but the molten metal does not intrude in the vicinity of this portion because of the line-broken portion 240.

Hence, the gas passage for causing some gas to pass through is still secured as indicated by the arrow. When this passage is absent, that is, when the band-shaped convex portion is a band extending in the horizontal direction, after the gas blowing operation is finished, gas molten metal intrudes into the whole of the slit. Therefore, when gas is blown next, it is necessary to blow off this portion by a high gas blowing pressure.

However, in this case as well, since the intrusion depth of molten metal is not greater than the slit depth, the wear caused by one gas blowing operation is smaller than the conventional plug, wherein the gas passage is constructed of a straight line shape, so that the life of the plug is increased. When the inclined portion 24 is present, some gas can be blown without blowing off the intrusion portion of molten metal. Therefore, in some cases, the gas blowing operation can be continued, and accordingly the life of the plug can be prolonged.

FIG. 5(B) shows a case where the slit formed by the band-shaped convex portion is exposed in the horizontal cross section. When the gas blowing operation continues, gas is blown from the slit indicated by the solid line. When the gas blowing operation is finished, molten metal intrudes into the hatched portion as denoted by reference numeral 241, and at the early stage of the next gas blowing operation, some gas is blown from a portion indicated by the arrow. However, in order to blow much gas, this stepped portion is blown off and the next slit, that is, the slit shown in FIG. 5(A) is exposed on the cross section, by which a sufficient amount of gas can be blown.

The width of slit is determined by the thickness of the paper etc. of the tubular body, being preferably about 0.1 to 0.4 mm. The pitch or distance of the band is preferably about 3 to 15 mm. When the molten metal is carbon steel, the band pitch or distance preferably about 3 to 10 mm, and when the molten metal is stainless steel, the band pitch or distance is preferably about 10 to 15 mm.

As described above, the plug in accordance with the present invention is a gas blowing plug for blowing gas from the bottom of a molten metal vessel, which is provided with the slit-shaped main gas passage 22 continuous from the bottom to the top of the plug. Preferably, as shown in FIG. 4, this gas passage is formed by the continuous slit-shaped gas passage or the discontinuous slit-shaped gas passage in the cross section of the plug. In the vertical cross section of the plug, the gas passage is formed by the slit-shaped main gas passage 22 continuous from the bottom to the top of the plug and the discontinuous slit-shaped gas passage 26.

Figure 6:
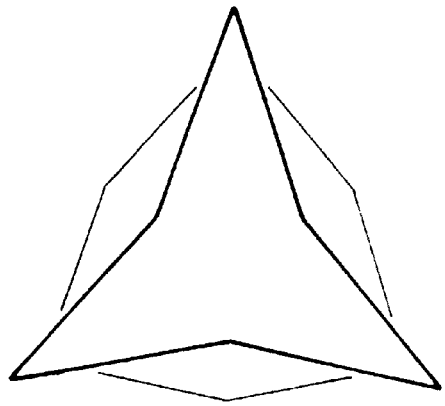
FIGS. 6A and 6B are views showing a slit shape in a horizontal cross section in a case where the cross-sectional shape of a tubular body is a three-pointed or four-pointed star.
Figure 6:
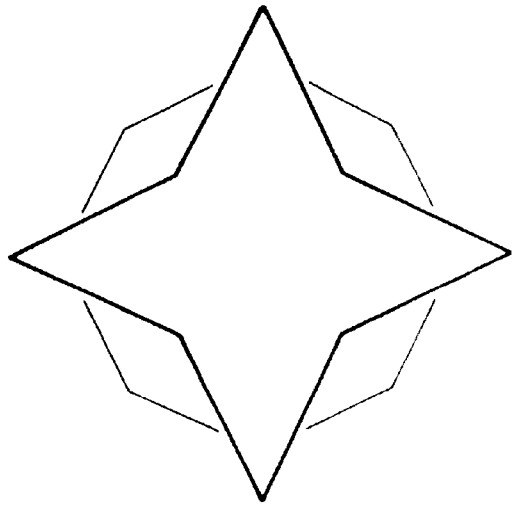
Figure 8:
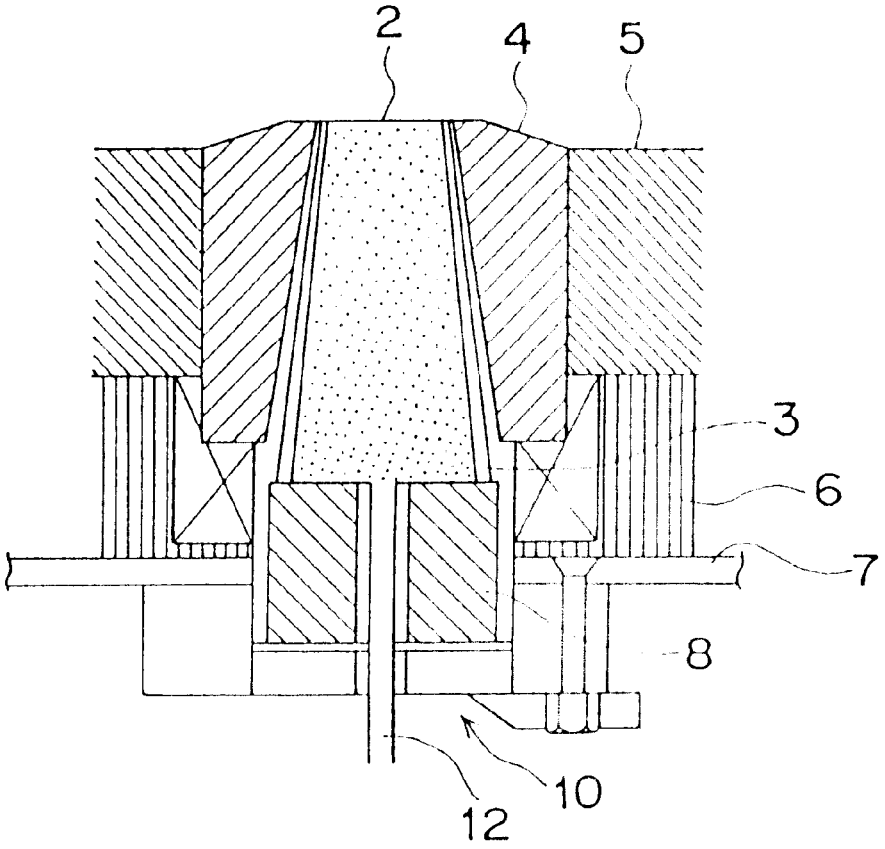
FIG. 8 Prior Art
FIG. 8 is a sectional view showing a conventional porous plug.

As shown in FIG. 6, the shape on the horizontal cross section may be a three-pointed or four-pointed star shape, and further a five-pointed or six-pointed star shape is suitable. A seven-pointed star shape and eight-pointed star shape are possible, but these shapes are somewhat difficult to manufacture. If the tubular body constructed as described above with a different diameter are put in a plug in a multiple form, and the plug is fired, a plug is manufactured having slit-shaped gas passages in a multiple form around the centerline of the cross section of the plug.

As described above, in the manufacturing method for this plug, a tubular body made of a combustible sheet is prepared, cuts are made for each convex portion of the tubular body at a predetermined intervals in the cross sectional direction at right angles to the axis of the tubular body, and a band-shaped convex portion is formed by projecting the cut portion from the inside to the outside. This tubular body is placed in a mold, which is filled uniformly with a monolithic refractory material. And the refractory material is compressed with an hydraulic press or by CIP (cold isostatic pressing) or vibration molding, and is dried at high-temperature or fired at about 1000° C., whereby the aforementioned combustible sheet is burned off.

As described above, the convex portion having the inclined portion inclining downward at both ends of the band-shaped portion formed by cutting of the tubular body provides a plug in which the slit is not closed completely can be manufactured even after the gas blowing operation is finished.

An example of characteristics of the plug manufactured by the method in accordance with the present invention is described below.

Plug size: diameter; 50 to 400 mm
height; 100 to 500 mm
permeability; 0.5 to 20 $cm^3$-cm/$cm^2$-s-$cmH_2O$ The characteristics of the conventional plug are as described below.

Plug size: diameter; 50 to 400 mm
height; 100 to 500 mm
permeability; 0.5 to 10 $cm^3$-cm/$cm^2$-s-$cmH_2O$ As described above, the permeability of the plug could be made two times and more.

FIG. 7 shows a comparison between the characteristics of the plug of the embodiment of the present invention and those of the conventional porous plug. In particular, in the embodiment of the present invention, the compressive strength of plug increased. Also, the number of charges is dramatically increased, being 15 charges and more as compared with the conventional 3 to 5 charges, and an excellent plug could be manufactured. Further, the quantity of air flow could be made much than before.

As described above, the gas blowing plug in accordance with the present invention is provided with a portion having a continuous gas passage and a portion having a discontinuous gas passage, so that a new cross section is exposed for each charge, whereby a larger quantity of gas can be blown than before. In particular, by making the gas passage in a slit shape, the property of the refractory material can be made denser, so that the plug life can be increased significantly.

What is claimed is:

1. A gas blowing plug for blowing gas from the bottom of a molten metal vessel, said gas blowing plug having a top end and a bottom end that is oppositely disposed from the top end, said gas blowing plug comprising:

a slit-shaped gas passage that extends from the bottom to the top of said plug, the intersection of said slit-shaped gas passage and a horizontal cross section of said plug defining a discontinuous slit-shaped passage, said slit-shaped gas passage forming a continuous passage between the bottom and the top of said plug; and said slit-shaped gas passage forming a discontinuous slit-shaped gas passage in the vertical cross section of the plug.

2. A gas blowing plug as claimed in claim 1, wherein said gas blowing plug further comprises a slit-shaped gas passage defining a discontinuous slit-shaped gas passage in horizontal cross section of said plug, said slit-shaped gas passage being continuous from the bottom to the top of said plug in vertical cross section of the plug.

3. The gas blowing plug according to claim 1 wherein said slit-shaped gas passage is formed by a continuous slit-shaped gas passage that defines a star shape in the horizontal cross section of the plug.

4. The gas blowing plug according to claim 1 wherein said slit-shaped gas passage is formed by a discontinuous slit-shaped gas passage that defines a star shape in the horizontal cross section of the plug.

5. The gas blowing plug according to claim 3 wherein said star shape defines at least three points on a star.

6. The gas blowing plug according to claim 5, wherein said star shape defines five points on a star.

7. The gas blowing plug according to claim 5, wherein said star shape defines six points on a star.

8. The gas blowing plug according to any of claims 1, 2, 3, 4, 5, 6, or 7 wherein said slit-shaped gas passage is formed in a multiple or spiral form around the centerline of the horizontal cross section of said plug.

9. A gas blowing plug for blowing gas from the bottom of a molten metal vessel, said gas blowing plug having a body of refractory material that defines a top end and a bottom end, said top end and said bottom end being located at positions on a longitudinal axis of said gas blowing plug such that the top end is oppositely disposed on the gas blowing plug body from the bottom end, said refractory material body also defining an internal, continuous gas passage that communicates between the top end and the bottom end of said gas blowing plug, said internal gas passage comprising:

a first slit-shaped gas passage portion that extends between the bottom end and the top end of said plug wherein the intersection of said first slit-shaped gas passage portion with a plane that is orthogonal to said longitudinal axis defines a discontinuous slit-shaped passage; and a second slit-shaped gas passage portion that is in communication with said first slit-shaped gas passage portion, wherein the intersection of said second slit-shaped gas passage portion and a plane that is parallel to said longitudinal axis defines a slit-shaped gas passage that is discontinuous.

10. The gas blowing plug of claim 9 wherein at least a portion of said first slit-shaped gas passage portion comprises a main gas passage.

11. The gas blowing plug of claim 10 wherein said second slit-shaped gas passage portion includes a plurality of convex portions, each of said convex portions being located at a respective, predetermined position along the longitudinal axis of said gas blowing plug.

12. The gas blowing plug of claim 11 wherein each of said convex portions respectively defines a first edge at one longitudinal position along the longitudinal axis and a second edge at a second longitudinal position along the longitudinal axis, where said first edge and said second edge are substantially orthogonal with respect to the longitudinal axis of the gas blowing plug.

13. The gas blowing plug of claim 12 wherein the convex portions of said second slit-shaped gas passage portion project in a radial direction away from the longitudinal axis of the gas blowing plug.

14. The gas blowing plug of claim 13 wherein the first edge and the second edge of said convex portions include an inclined section adjacent to the terminal portions of said first and second edges, the intersection of a plane that is orthogonal to said longitudinal axis with said first slit-shaped gas passage portion and also with said inclined sections of one of said first and second edges defining a discontinuous slit-shaped passage in said first slit-shaped gas passage portion.

15. The gas blowing plug of claim 13 wherein the first edge and the second edge of said convex portions include an inclined section adjacent to the terminal portions of said first and second edges, the intersection of a plane that is orthogonal to said longitudinal axis with said second slit-shaped gas passage portion and also with said inclined sections of one of said first and second edges defining a discontinuous slit-shaped passage in said second slit-shaped gas passage portion.

16. The gas blowing plug of claim 9 wherein the continuous slit-shaped passage of said first slit-shaped gas passage portion defines a star having at least three points.

17. The gas blowing plug of claim 9 wherein said first slit-shaped gas passage portion and said second slit-shaped gas passage portion have a thickness in cross-section in the range of 0.1 to 0.4 millimeters.

18. The gas blowing plug of claim 9 further comprising a second internal, continuous gas passage that communicates between the top end and the bottom end of said gas blowing plug, said second internal continuous gas passage being located concentrically with respect to the longitudinal axis of the gas blowing plug and also being located concentrically with respect to the first internal continuous gas passage.

* * * * *